US006607876B2

(12) United States Patent
Elst et al.

(10) Patent No.: US 6,607,876 B2
(45) Date of Patent: Aug. 19, 2003

(54) RADIOGRAPHIC FILM MATERIAL AND INTENSIFYING SCREEN-FILM COMBINATION

(75) Inventors: Kathy Elst, Kessel (BE); Paul Callant, Edegem (BE); Ilse Mans, Herenthout (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/995,918

(22) Filed: Nov. 28, 2001

(65) Prior Publication Data

US 2002/0127503 A1 Sep. 12, 2002

Related U.S. Application Data

(60) Provisional application No. 60/267,158, filed on Feb. 7, 2001.

(30) Foreign Application Priority Data

Dec. 21, 2000 (EP) ..... 00000004

(51) Int. Cl.[7] ..... G03C 1/005; G03C 1/494

(52) U.S. Cl. ..... 430/567; 430/139; 430/966; 430/570; 430/581; 430/585; 430/588; 430/603; 430/604; 430/605

(58) Field of Search ..... 430/139, 567, 430/966, 570, 581, 585, 588, 603, 604, 605

(56) References Cited

U.S. PATENT DOCUMENTS 6,200,743 B1 * 3/2001 Elst et al. ..... 430/581
6,342,338 B1 * 1/2002 Verbeeck et al. ..... 430/567
6,346,360 B1 * 2/2002 Verbeeck et al. ..... 430/567
6,348,293 B1 * 2/2002 Verbeeck et al. ..... 430/966
6,403,276 B1 * 6/2002 Elst et al. ..... 430/139
6,472,137 B1 * 10/2002 Verbeeck et al. ..... 430/567

FOREIGN PATENT DOCUMENTS

DE 39 25 334 2/1990

OTHER PUBLICATIONS

European Search Report, EP 00 00 0004, Sep. 10, 2001.

* cited by examiner

*Primary Examiner*—Geraldine Letscher
(74) *Attorney, Agent, or Firm*—Josephy T. Guy; Nexsen Pruet Jacobs & Pollard, LLC

(57) ABSTRACT

A radiographic silver halide film material and a radiographic screen/film combination has been disclosed, said material having in at least one light-sensitive layer thereof an emulsion comprising {111} tabular silver halide grains rich in silver bromide, spectrally sensitive to irradiation in the wavelength range between 540 and 555 nm by the presence of a combination of at least one J-aggregating spectrally sensitizing cyanine dye according to the formula (I) and of at least one additional cyanine dye providing a shift of maximum absorption wavelength of said combination of less than 10 nm versus in the absence thereof, wherein said additional cyanine dye is at least one monomethine cyanine dye according to the formula (II), essentially having a solubilizing group or a latent solubilizing group, said dyes having been given in the description and in the claims of the present invention.

20 Claims, No Drawings

RADIOGRAPHIC FILM MATERIAL AND INTENSIFYING SCREEN-FILM COMBINATION

This application claims benefit of U.S. Provisional Application No. 60/267,158 filed Feb. 7, 2001.

FIELD OF THE INVENTION

This invention relates to a silver halide photographic light-sensitive material and, more particularly, to a silver halide photographic light-sensitive material containing tabular silver halide grains for use in a radiographic film materials and screen-film combinations thereof.

BACKGROUND OF THE INVENTION

Combinations of intensifying screens provided with luminescent phosphors and light-sensitive silver halide photographic materials are conventionally used for medical diagnosis. By X-ray radiation the luminescent phosphors in the screen panel or panels are converting X-rays into visible radiation, thereby exposing the film material in contact with the said panel (for single-side coated materials as e.g. in mammography) or panels (for duplitized materials as e.g. in chest imaging).

It is clear that in order to get an image to be examined on the film that after said exposure the film material is processed in a wet processing cycle, requiring appropriate chemistry. A normal processing cycle, whether or not performed in an automatic processing machine, is following the steps of developing, fixing, rinsing an drying. The more film material is passing in the corresponding processing solutions of developer and fixer, the more both of them become exhausted. In order to overcome that problem replenishing is required.

As nowadays ecology becomes more and more important it is recommended to reduce amounts of processing chemicals (developer, fixer and corresponding replenishers) to a considerable extent in order to reduce waste chemicals. Within the same context it is recommended to reduce wash out or rinsing out of chemical compounds coated in the film material as e.g. wash out in the processing of sensitizing dyes or filter dyes present in hydrophilic layers of the said film material thereby causing deposition of dirt on the walls and rollers of the processing tanks.

Especially when the light-sensitive silver halide emulsion crystals have been made sensitive to visible light as e.g. to blue or green light emitted from blue light or green light emitting intensifying phosphor screens the corresponding spectral sensitizers and optionally present filter or antihalation dyes make arise the problem of insufficient removal from the film material, thereby causing residual color making increase minimum density and deviate image tone from the desired outlook of the processed image.

Silver bromide emulsion crystals have an absorption spectrum which is shifted towards longer wavelengths of the radiation spectrum if compared with silver chloride emulsion crystals the spectrum of which is shifted more to the ultraviolet range. Luminescent phosphors however are not completely matching the absorption spectra of non-spectrally sensitized emulsion crystals so that spectrally sensitizing dyes are required in order to provide, after processing of the (preferably forehardened) photographic material, an image having a suitable gradation, high covering power and low cross-over (leading to a high sharpness) as has e.g. been recommended in U.S. Pat. Nos. 4,414,304; 4,425,425 and 4,425,426 in order to make use of emulsion crystals or grains having a tabular habit and a high aspect ratio. As this application technique makes improvement of covering power of silver halide possible, it is desired in view of saving silver. Said advantage of silver saving, expressed as a lower coating weight, is the more preferred as rapid processing applications are required, which is nowadays an ever more returning demand.

Attaining the required sensitometry, particularly speed, even in a rapid processing cycle of at most 90 seconds, making use of minimum amounts of replenisher solutions of developer and fixer, and further getting an image having the desired contrast, high definition, covering power and image tone (the improvement of which has e.g. been demonstrated in EP-A 0 770 909, wherein use has been made of a specific multi-layer arrangement with grains having a cubic crystal habit located farther from the support without showing disturbing residual coloration) remains an ever lasting demand.

Besides the disadvantage of providing a brownish image tone as becomes more stringent for thinner tabular grains or crystals, light-sensitive materials making use of tabular silver halide grains are susceptible to changes in development processing conditions. Therefore, application of thin tabular grains in silver halide photographic materials requires additional research in order to make those materials less dependent on the said development processing conditions, more particularly with respect to sensitometry, covering power and image tone as these are still not completely satisfactory.

OBJECTS OF THE INVENTION

It is, therefore, an object of the present invention to provide a silver halide photographic light-sensitive material containing thin tabular silver halide grains which is improved with respect to dependence of photographic properties on development processing conditions, and, more particularly, with a reduced dependence of covering power and image tone on the said development processing conditions.

Further it is an object of the present invention to provide a silver halide photographic light-sensitive material containing tabular silver halide grains which is improved with respect to dye stain (residual color), thus preventing said stain from appearing onto the photographic light-sensitive film material after processing.

It is still a further object of the present invention to provide a silver halide X-ray photographic material containing thin tabular silver halide grains which is improved, after having been indirectly exposed to X-rays in a film/screen combination with an intensifying luminescent screen, with respect to the dependence of sensitivity in varying processing conditions, i.e., even in a processing cycle wherein a weak developer or a nearly exhausted developer is used.

SUMMARY OF THE INVENTION

As a result of various investigations, it has been found that the above-described problems can effectively be overcome and that the objects of the present invention can be attained by providing a silver halide photographic film material having at least one emulsion comprising {111} tabular silver halide grains rich in silver bromide, spectrally sensitive to irradiation in the (green) wavelength range between 540 and 555 nm by the presence of a combination of at least one J-aggregating spectrally sensitizing cyanine dye according to the general formula (I), and of at least one additional cyanine dye, characterized in that said additional cyanine dye or dyes provide(s) a shift of maximum absorption wavelength of said combination being less than 10 nm versus in the absence thereof, wherein said at least one monomethine cyanine dye corresponds to the formula (II), and wherein it is essential that said monomethine cyanine dye has at least one solubilizing group.

In a further embodiment an azacyanine dye is additionally present.

The formulae (I) and (II) will further be explained both in the detailed description hereinafter and in the claims.

Moreover a radiographic screen/film combination has been claimed, said combination comprising a duplitized film material sandwiched between a pair of supported or self-supporting X-ray intensifying screens, characterized in that said pair of supported or self-supporting X-ray intensifying screens essentially consists of luminescent phosphor particles emitting at least 50% of their emitted radiation in the wavelength range between 540 and 555 nm, and wherein said film material is a material according to the present invention as claimed.

DETAILED DESCRIPTION OF THE INVENTION

In order to prevent loss of speed and in order to prevent residual color or dye stain after processing it is advised not to use antihalation dyes as those described e.g. in U.S. Pat. No. 5,298,378 which are favorable in order to reduce internal scatter and print-through as disclosed therein, although dye stain may also be present after processing due to the presence, in high amounts of spectral sensitizing dyes, on the large main (111) faces of tabular grain emulsions having a large surface to volume ratio. As can be examined from the diagnostic images obtained after processing of a film material according to the present invention it has now unexpectedly been observed that the objects of the present invention are effectively attained when besides main spectral sensitizing dyes for the spectral sensitization in the green part of the visible wavelength spectrum, and more particularly in the wavelength range between 540 and 555 nm, of {111} tabular grains rich in silver bromide, other cyanine dyes, and moreover monomethine cyanine dyes essentially having at least one solubilizing group, are present in the light-sensitive emulsion layer(s) of the said silver halide photographic material for use in a screen/film system of the present invention, said emulsion layer(s) being present in at least one light-sensitive emulsion layer at both sides of a film support.

Moreover presence of an azacyanine dye is highly preferred.

In the film material according to the present invention said film thus comprises {111} tabular silver halide grains rich in silver bromide, spectrally sensitive to irradiation in the said wavelength range between 540 and 555 nm, of at least one J-aggregating green-sensitizing dye according to the formula (I) and at least one other cyanine dye, providing a and of at least one additional cyanine dye, providing a shift of maximum absorption wavelength of said combination of less than 10 nm, more preferably of less than 5 nm and even more preferably of from 0 up to 2 nm, versus in the absence thereof.

In a preferred embodiment according to the present invention said cyanine dye, differing from the green-sensitizing dye according to the formula (I) is a monomethine dye according to the formula (II), wherein in formula (I), representative for said (green-sensitizing) cyanine dye, (I)

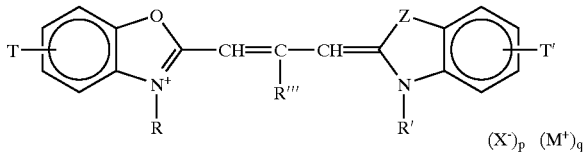

Z represents a nitrogen or an oxygen atom and is substituted with R" if Z is a nitrogen atom, R, R' and R" each independently represents substituted or unsubstituted alkyl, R''' represents hydrogen, substituted or unsubstituted alkyl or substituted or unsubstituted aryl, T and T' each independently represents the usual substituents known in the art, $(X^-)_p$ represents an negatively charged atom or group of atoms to compensate for the positive charge(s) present on the dye, and $(M^+)_q$ represents a positively charged atom or group of atoms to compensate for the negative charge(s) present on the dye, wherein p and q each represent an integer in order to get an electronically neutral compound.

In the said trimethine cyanine dye according to the general formula (I) the usual substituents T and T' known in the art each independently represents hydrogen, 5-phenyl, 5-Cl, 5-$OCH_3$ or 5-$CH_3$ and T' represents 5,6-$(Cl)_2$; 5-CN-6-Cl; 5-Cl; 5-CN; 5-$CF_3$; 5-$CHF_2$; 5-$SO_2$—$CH_3$; 5-CO—$OCH_3$, whether or not fluoro-substituted; 5-$SO_2$—$NR^xR^y$ or 5-CO—$NR^xR^y$, wherein $R^x$ and $R^y$ each independently represent substituted or unsubstituted alkyl groups, or independently or together form a ring with the N-atom to which they are attached.

Especially preferred structures of the type wherein Z represents oxygen are those wherein T and T' each represent Cl or T represents 5-Cl and T' represents 5-Phenyl or vice versa and wherein R and R' each independently represents one of the combinations of the formulae —$(CH_2)_nSO_3^-$ wherein n equals 2, 3 or 4;

—$(CH_2)_2CH(CH_3)$—$SO_3^-$ and

—$(CH_2)CHY$—$CH_2$—$SO_3^-$ and wherein Y represents —OH or $Cl^-$;

or wherein R represents one of the formulae given above and R' corresponds to one of the formulae —$CH_2)_pH$ wherein p equals 1, 2, 3 or 4;

—$(CH_2)$-Phen-$SO_3^-$ wherein Phen=phenyl;

—$(CH_2)_q$-Phen-COOH and wherein q equals 1, 2 or 3.

In the at least one monomethine cyanine dye according to the formula (II)

(II)

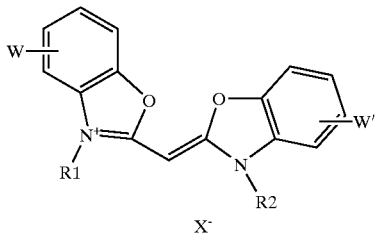

each of $R^1$ and $R^2$ independently represents a substituted or unsubstituted $C_1$–$C_5$ alkyl chain, or a substituted or unsubstituted (five- or six-membered) aromatic ring, provided that at least one of $R^1$ and $R^2$ has a solubilizing group or a latent solubilizing group;

W and W' each independently represents a substituted or unsubstituted alkyl, a substituted or unsubstituted aryl or a substituted or unsubstituted heterocyclic group and X is an anion, providing electrical neutrality.

In another embodiment each of $R^1$ and $R^2$ may independently represent $(CH_2)_{n''}H$ or $(CH_2)_{n''}OH$, n" being an integer having a value from 1 to 4, $(CH_2)_{m''}(SO_3^-)$ or $(CH_2)_{m''}O(SO_3^-)$, m" being an integer having a value from 2 to 4, $(CH_2)_2CH(Y'')SO_3^-$ wherein Y" represents $CH_3$—, —Cl or —OH;

$(CH_2)_{m''}N(R)SO_3^-$ or $(CH_2)_{m''}N(R')SO_3^-$ $(CH_2)_{n''}(COO^-)$ or $(CH_2)_{n''}(COOH)$, $(CH_2)_{n''}CONHSO_2R$ or $(CH_2)_{n''}CONHSO_2R'$, wherein R and R' have the same meaning as explained hereinbefore and wherein X is an anion, providing electrical neutrality of the molecule;

$(CH_2)_{n''}(COO^-)$ or $(CH_2)_{n''}(COOH)$, $(CH_2)_{s''}SO_2^-(CH_2)_{t''}H$ wherein s" equals 2 or 3 and t" equals 1 or 2;

$(CH_2)_{x''}$-Phen-W", wherein W" represents —$COO^-$ or $SO_3^-$; Phen represents phenyl which is substituted or unsubstituted; and x" equals 1, 2, 3 or 4;

a latent solubilizing group as, $(CH_2)_{m'''}$—(C=O)—O—$CH_2$—(C=O)—$CH_3$, wherein m'" is an integer having a value of from 1 to 5 or $(CH_2)_{n''}CONHSO_2R$ or $(CH_2)_{n''}CONHSO_2R'$, provided that R' may represent hydrogen as set forth hereinbefore.

When W and/or W' represent(s) a substituted or unsubstituted heterocyclic group, said heterocyclic group may be a saturated or unsaturated five membered or six membered ring, whether or not conjugated with a benzene ring.

As will become clear from the Examples given hereinafter the said J-aggregating green-sensitizing cyanine dye or dyes are present besides the preferred at least one monomethine cyanine dye (the preferred formulae of which have been given under formulae II.1–II.3) in order to reach the objects of the present invention, thereby reducing dye stain after processing and retaining sensitometry (speed), covering power and image tone in varying processing conditions. In another embodiment said cyanine dye differing form the J-aggregating green-sensitizing cyanine dye or dyes according to the formula (I) is an azacyanine dye.

Said sensitizing dyes are added as first ingredient during the chemical ripening procedure, before addition of the other chemical ripening compounds or agents as will further be illustrated in the Examples given hereinafter. It is preferred to first add the monomethine cyanine dye or dyes before the green-sensitizing cyanine dye. Mixtures of both types of dyes, i.a. the monomethine cyanine dye(s) and the green-sensitizing (trimethine) cyanine dyes may also be added.

Monomethine cyanine dyes as those represented by the general formula (II), and more particularly those represented by the formulae (II.1–II.3) given hereinafter, are added in lower amounts than the green-sensitizing trimethine dyes acting as main spectral sensitizers in order to make the film sensitive in the particular wavelength range between 540 and 555 nm, the corresponding radiation having said wavelength range, emitted by the luminescent phosphors in the intensifying screens in contact with the film. The said lower amounts of monomethine cyanine dyes result in a preferred molar ratio between monomethine dyes and trimethine dyes of less than 5:10 and even more preferably of less than 1:10.

A typical example of a preferred trimethine cyanine dye is the oxa-carbocyanine dye according to the formula (I.1) given hereinafter:

(I.1)

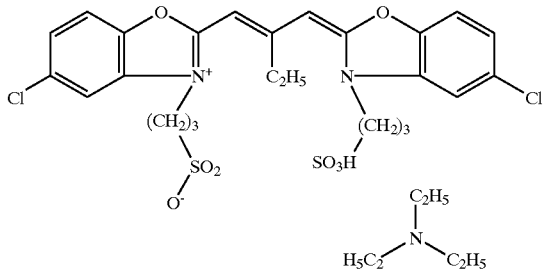

Preferred structures for the monomethine dyes according to the general formula (II), without being exhaustive therefor, have been given hereinafter in the formulae (II.G1)–(II.G6).

(II.G1)

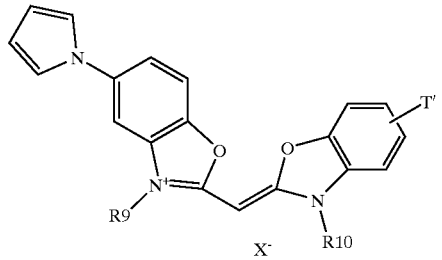

(II.G2)

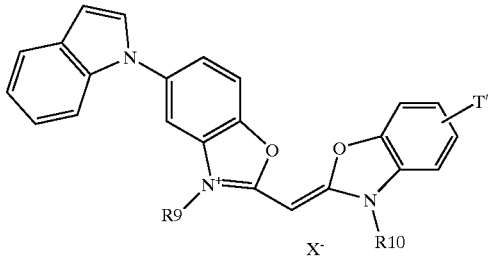

(II.G3)

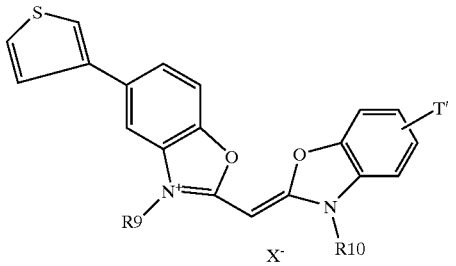

(II.G4)

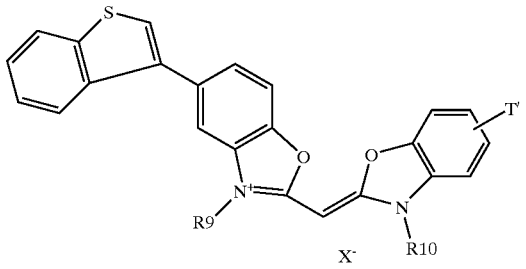

-continued (II.G5)

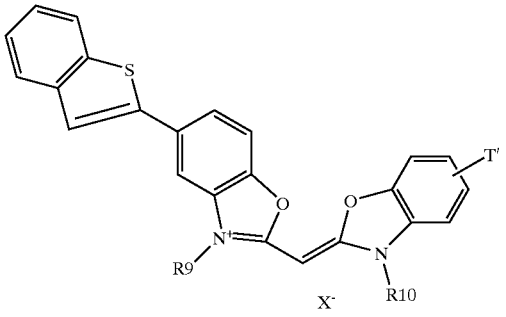

(II.G6)

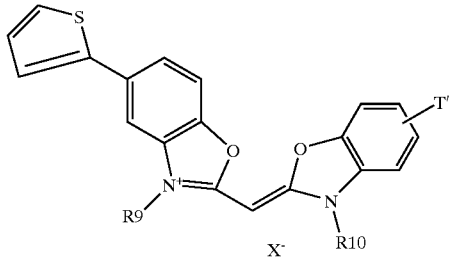

Particularly preferred monomethine cyanine dyes which may be used as monomethine cyanine dyes in emulsions coated in light-sensitive layers of the material used in the film/screen system of the present invention, together with the main J-aggregating green spectral sensitizer, correspond to the formula (II.1)–(II.3), represented hereinafter:

(II.1)

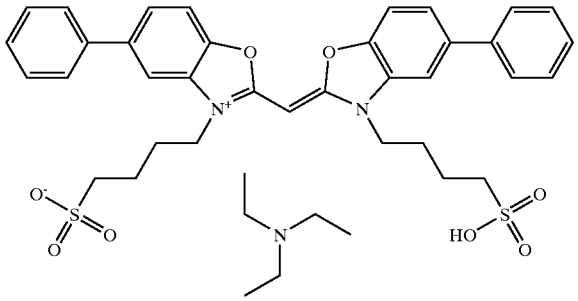

(II.2)

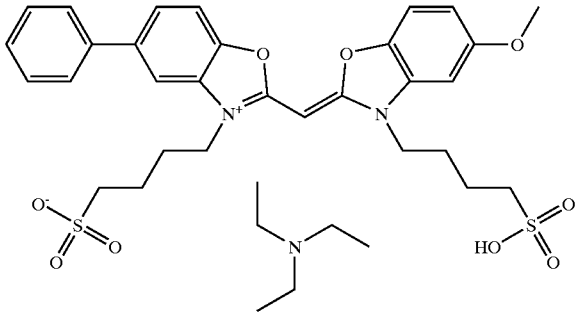

-continued (II.3)

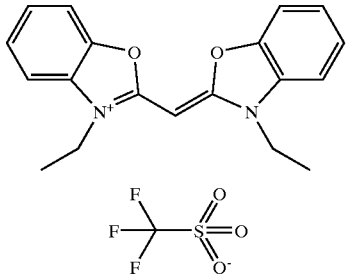

The film material according to the present invention comprises light-sensitive layers at both sides of the film support wherein {111} tabular silver halide grains rich in silver bromide are present, wherein, in a preferred embodiment said {111} tabular silver halide grains rich in silver bromide have a silver iodide content of less than 3 mole %, and even more preferably from 0.05 up to 1 mole % of silver iodide, based on silver, and have an average aspect ratio of 5 or more, an average grain thickness of at most 0.25 μm, and account for at least 50% of the total projective area of all grains. In a further embodiment according to the present invention said film material is coated with light-sensitive layers at both sides of the film support wherein {111} tabular silver brom(oiod)ide grains have an average aspect ratio of from 5 up to 20, an average grain thickness of less than 0.1 μm, and account for at least 70% of the total projective area of all grains.

In a further preferred embodiment the tabular grain population making part of a light-sensitive emulsion is homogeneous with respect to average grain surface and/or thickness, i.e., has a variation coefficient of less and 0.40 and more preferably even from 0.10 up to 0.30.

Preparation methods for {111} tabular grain emulsions rich in silver bromide can be found in Research Disclosure No. 389057, p. 591–639 (1996), more particularly in Chapter I. A very useful method has been described in EP-A 0 843 208.

Said {111} tabular crystals rich in silver bromide are composed of silver bromide, silver bromochloride, silver bromochloroiodide or silver bromoiodide. When iodide is present it is preferred, in the context of rapid processing (developing and fixing) ability, to have at most 3 mole % of iodide present, more preferably at most 1 mole % and even still more preferably from 0.05 up to 0.5 mole %. Iodide ions may be divided homogeneously over the tabular grain volume, but it can be preferred to build up a core-shell structure wherein the shell is containing more or less iodide than the core or wherein both distinct phases are separated by a silver halide band rich in silver iodide, or even consisting of pure silver iodide, realized e.g. by conversion wherein iodide ions are replacing halides of much more soluble silver halide salts as silver chloride and/or silver bromide. Addition of iodide is normally performed by addition of an inorganic iodide salt as potassium iodide. If slower liberation of iodide in the reaction is desired addition of organic iodide releasing agents leads to an increased iodide concentration.

Addition of iodide by organic agents releasing iodide ions, which is an embodiment which can advantageously be applied within the context of the preparation of emulsions for use in materials according to the present invention, is in favour of the realization of homogeneous distribution of iodide into the crystal volume of {111} tabular grains or crystals containing silver iodide as has been demonstrated e.g. in EP-A's 0 561 415, 0 563 701, 0 563 708 and 0 651

284 and in U.S. Pat. Nos. 5,482,826 and 5,736,312. In an alternative method iodide ions can be released from iodate as has been described in U.S. Pat. No. 5,736,312. Release of iodide in the presence of a compound adjusting the rate of iodide release can be applied as described in U.S. Pat. No. 5,807,663 in order to get a multilayered structure in the silver halide tabular emulsion grains.

Addition of iodide to emulsion grains rich in silver bromide is however also possible by adding fine preformed grains of silver iodide, whether or not including bromide and/or chloride in minor amounts, said grains having a grain diameter of not more than 100 nm, and, more preferably, not more than 50 nm. Such fine grains are so-called "Lippmann" emulsions. Addition of iodide making use from such fine silver iodide grains has been described for the preparation of {111} tabular grains in JP-A's 04-251241 and 08-029904 and in EP-A's 0 662 632 and 0 658 805, wherein an outermost phase rich in silver iodide has been added to {111} tabular grains rich in silver bromide. More particularly ultrafine AgI-grains can be introduced as seed emulsions as has been described in EP-A 0 621 505 or can be used in order to prepare core-shell emulsions as described in EP-A 0 517 434, wherein two phases in the crystal differing in composition have thus been built up. In order to improve speed supplying of said ultrafine grains may proceed in the presence of an oxidizing agent as has been described in EP-A 0 576 920. Addition of said fine AgI-Lippmann emulsion grains to the surface of the silver halide crystals in order to get a global iodide content of less than 1 mole % in the grain may advantageously proceed as disclosed in EP-A 0 475 191, wherein an excellent speed/fog ratio and a high covering power are attained.

It is clear that {111} tabular silver halide emulsion grains, present in light-sensitive emulsion layers of materials according to the present invention, are, besides spectrally sensitized, also chemically sensitized, preferably with compounds providing sulphur, selenium and gold. Chemical sensitization methods for {111} tabular grain emulsions rich in silver bromide can be found in Research Dislosure No. 389057, p. 591–639 (1996), more particularly in Chapter IV. Very useful methods related therewith have been disclosed in EP-A's 0 443 453, 0 454 069, 0 541 104 and in U.S. Pat. Nos. 5,112,733 and 5,654,134 wherein further use of labile tellurium compounds has been claimed. Useful labile selenium compounds have been disclosed in EP-A's 0 831 363, 0 889 354 and 0 895 121.

Preparation of spectrally and chemically sensitized tabular grains as applied to emulsion grains to be coated in one or more light-sensitive layer of a material according to the present invention has been described in U.S. Pat. No. 4,439,520, wherein it has been established to perform spectral sensitization before chemical sensitization, so that the spectral sensitizer acts as a site-director for the sensitivity specks, generated during chemical sensitization. A broad review about spectral sensitization can be found in in Research Dislosure No. 389057, p. 591–639 (1996), more particularly in Chapter V. Further useful information about additives which may be used in order to prepare emulsions to be coated in a material according to the present invention can be found in Research Dislosure No. 389057, p. 591–639 (1996), as in Chapter VII about antifoggants and stabilizers, in Chapter VIII about coating physical property modifying addenda, in Chapter XI about layer arrangements and in Chapter XV about supports.

As it is a favorable aspect for materials coated from emulsions having tabular grains to be coated with lower amounts of silver without loss of covering power in the material according to the present invention the total amount of coated silver halide in said film, expressed as an equivalent amount of silver nitrate, is less than 6.0 g/m$^2$.

In practical applications the film material according to the present invention preferably is a duplitized material, i.a., a light-sensitive photographic material comprising in its light-sensitive emulsion layers coated on both sides of a subbed support an emulsion having {111} tabular grains rich in silver bromide, spectrally sensitive to irradiation in the wavelength range between 540 and 555 nm by the presence of at least one green-sensitizing trimethine spectral sensitizer according to the formula (I) and of at least one monomethine cyanine dye corresponding with the formula (II) as described hereinbefore. It is however clear that use of a duplitized material as in the present invention does however not exlude use in a single-side coated material, whether or not in radiographic applications, as such a black-and-white silver halide material can also be used e.g. in micrography, in aviation photography, in black-and-white cinefilms, in laserfilms or hardcopy films and in graphic or reprographic applications.

Said duplitized film materials for use in radiographic applications are irradiated by the light emitted imagewise by X-ray intensifying screens in intimate contact therewith at both sides of the coated film support during X-ray exposure of part of a patient. A diagnostic silver image thereof, in conformity with the X-ray image, is obtained after processing of the said film material. For use in common medical radiography (projection radiography) the X-ray film material comprises a transparent film support, coated on both sides with at least one silver halide emulsion layer, further overcoated with at least one protective antistress layer and, optionnally, an afterlayer as disclosed e.g. in EP-A's 0 644 454 and 0 644 456. During X-ray irradiation said film is arranged in a cassette between two X-ray intensifying screens, each of them making contact with its corresponding light-sensitive side, thus forming a film/screen system.

According to the present invention a radiographic screen/film combination or system has been provided comprising a duplitized film material, sandwiched between a pair of supported or self-supporting X-ray intensifying screens, characterized in that i) said pair of supported or self-supporting X-ray intensifying screens essentially consists of luminescent phosphor particles emitting at least 50%, and, more preferably, at least 80% of the total radiation absorption, by the said grains of their emitted radiation in the wavelength range between 540 and 555 nm, ii) said film material is a material according to the present invention as disclosed hereinbefore, wherein said emulsion is present in at least one light-sensitive emulsion layer at both sides of a film support.

Luminescent phosphors suitable for use in a conventional intensifying screen of a radiographic film/screen system as the one according to the present invention must have a high prompt emission of fluorescent light on X-ray irradiation and low afterglow in favour of image sharpness. The relationship between resolution and speed of X-ray intensifying screens is described e.g. in Med. Phys. 5(3), 205 (1978). Specific intensifying screens emitting green light having the preferred wavelength range have been described in EP-A's 0 299 409, 0 712 036 and 0 930 527; as well as in U.S. Pat. No. 5,380,636. Preferred luminescent phosphors therein are the well-known gadolinium oxysulfide phosphors used therein and more in detail luminescent phosphor particles are $Gd_2O_2S$:Tb phosphor particles.

X-ray intensifying screens according the present invention can be self-supporting or supported. X-ray intensifying screens in accordance with the present invention generally comprise in order: a support (also called substrate), at least one layer comprising phosphor particles dispersed in a suitable binder and a protective coating coated over the phosphor containing layer to protect said layer during use. Further, a primer layer is sometimes provided between the phosphor containing layer and the substrate to closely bond said layer thereto. Examples of support materials include cardboard, plastic films such as films of cellulose acetate, polyvinyl chloride, polyvinyl acetate, polyacrylonitrile, polystyrene, polyester, polyethylene terephthalate, polyamide, polyimide, cellulose triacetate and polycarbonate; metal sheets such as aluminum foil and aluminum alloy foil; ordinary papers; baryta paper; resin-coated papers; pigment papers containing titanium dioxide or the like; and papers sized with polyvinyl alcohol or the like. A plastic film is preferably employed as the support material. Depending on the speed class of the screens for which a synergistic effect should be attained in the relation between speed and sharpness, supports characterized by their reflectance properties, expressed as % reflectance over the wavelength range from 350 to 600 nm, are particularly used. Such supports can be highly light reflecting as e.g. polyethylene terephthalate comprising a white pigment, e.g. $BaSO_4$, $TiO_2$, etc., or it can be light absorbing supports, e.g. polyethylene terephthalate comprising a black pigment, e.g. carbon black. Supports comprising dyes or pigments that absorb light of a specific wavelength can also be useful in the preparation of X-ray intensifying screens in the film/screen system according to the present invention.

In most applications the phosphor layers contain sufficient binder to give structural coherence to the layer. In view of a possible phosphor recovery from worn-out screens the binder of the phosphor containing layer is preferably soluble and remains soluble after coating. Useful binders, a non-limitative survey of which is given herein, include proteinaceous binders, e.g. gelatin, polysaccharides such as dextran, gum arabic, and synthetic polymers such as polyvinyl butyral, polyvinyl acetate, nitrocellulose, ethylcellulose, vinylidene chloride-vinyl chloride copolymer, polyalkyl (meth)acrylate, vinyl chloride-vinyl acetate copolymer, polyurethane, cellulose acetate, cellulose acetate butyrate, polyvinyl alcohol, polystyrene, polyester, etc. These and other useful binders are disclosed e.g. in U.S. Pat. Nos. 2,502,529; 2,887,379; 3,617,285; 3,300,310; 3,300,311 and 3,743,833. A mixture of two or more of these binders may be used, e.g., a mixture of polyethyl acrylate and cellulose acetobutyrate. The weight ratio of phosphor to binder is generally within the range of from 50:50 to 89:11, preferably from 80:20 to 89:11.

The screen according to the present invention may comprise a supported layer of phosphor particles dispersed in a binding medium comprising one or more rubbery and/or elastomeric polymers as described in EP-A's 0 647 258 and 0 648 254. In this way a ratio by weight of pigment to binding medium of more than 90:10 and more preferably of at least 93:7, e.g. 98:2 can be obtained providing besides an excellent image resolution a high ease of manipulation as a result of a good elasticity of the screen and good adhesion properties between the support and the phosphor layer. Problems concerning staining of screens comprising said rubbery binder(s) may be overcome by the addition of known rubber anti-oxidation compounds like IRGANOX 1010 and IRGASTAB T36 (trademarked products of CIBA-GEIGY, Basel, Switzerland), ANTIOXIDANT 330 (trademarked product of ETHYL CORP.,Richmond,USA), VANOX 2246 (trademarked product of VANDERBILT ENERGY CORP., Denver, Canada) etc., this list being non-limitative. The binder used in screens according to the present invention, with high phosphor to binder ratio, can beneficially be a polymer such as the polymers having been disclosed in EP-A 0 758 012 and the corresponding U.S. Pat. No. 5,663,005.

The phosphor layer can be applied to the support by employing a method such as vapour deposition, sputtering and spraying but is usually applied by the following procedure. Phosphor particles and a binder are added to an appropriate solvent as described hereinafter, and are then mixed in order to prepare a coating dispersion comprising the phosphor particles homogeneously dispersed in the binder solution. Said coating dispersion may further comprise a dispersing agent and plasticizer and filler material as described hereinafter. The coating dispersion containing the phosphor particles and the binder is applied uniformly onto the surface of the support to form a layer of the coating dispersion. The coating procedure may proceed according to any conventional method such as doctor blade coating, dip-coating or roll coating.

For the preparation of highly abrasion resistant and chemically resistant phosphor-binder layers the binder is cured. Curing of the binder may proceed photochemically by means of UV radiation or with electron beam (EB) as described e.g. in Research Disclosure December 1977, item 16435 or proceeds purely chemically as described e.g. in U.S. Pat. No. 4,508,636. It may also be cured by moisture as described in EP-A 0 541 146. Curing may also be performed by heating.

In the preparation of the phosphor screen having a primer layer between the substrate and the fluorescent layer, the primer layer is provided on the substrate beforehand, and then the phosphor dispersion is applied to the primer layer and dried to form the fluorescent layer. After applying the coating dispersion onto the support, the coating dispersion is then heated slowly to dryness in order to complete the formation of a phosphor layer. In order to remove entrapped air in the phosphor coating composition as much as possible it can be subjected to an ultrasonic treatment before coating. The phosphor-binder layer (as described e.g. in U.S. Pat. No. 4,059,768) can be calendered to improve the phosphor packing density in the dried layer.

Useful solvents for the binder of the phosphor containing layer, employable in the preparation of the phosphor coating dispersion include lower alcohols such as methanol, ethanol, n-propanol and n-butanol; chlorinated hydrocarbons such as methylene chloride and ethylene chloride; ketones such as acetone, butanone, methyl ethyl ketone and methyl isobutyl ketone; esters of lower alcohols with lower aliphatic acids such as methyl acetate, ethyl acetate and butyl acetate; ethers such as dioxane, ethylene glycol monoethylether; methyl glycol; and mixtures of the above-mentioned solvents.

Useful dispersing agents for the phosphor particles in the coating dispersion to improve the dispersibility of the phosphor particles therein, may contain a variety of additives such as a plasticizer for increasing the bonding between the binder and the phosphor particles in the phosphor layer. Examples of the dispersing agent include ionic and nonionic well-known dispersing agents or combinations thereof, e.g., DISPERSE AYD (trade name of Daniel Products Company, New Jersey, USA) GAFAC RM 610 (a tradename a polyoxyethylene (20) sorbitan monopalmitate and monolaurate marketed by General Aniline and Film Company (GAF) New York, USA, polymeric surfactants such as the acrylic graft copolymer, PHOSPHOLIPON 90 (trade name) marketed by Nattermann-Phospholipid GmbH, Köln, W.

Germany, silane dispersing agents and surfactants e.g. DOW CORNING 190 (trade name) and SILANE Z6040 (trade name) marketed by Dow Corning Corporation, Midland, Mich., USA or glymo-3-glycidyloxy-propylmethoxysilane or organosulfate polysilanes, unsaturated p-aminamide salts and high molecular acid esters such as ANTI TERRA U 80 (trade name) marketed by BYK-Chemie GmbH, Wesel, W. Germany, high molecular unsaturated polyesters, etc. Dispersing agents are added in an amount of 0.05 to 10% by weight based on the phosphor.

Useful plasticizers include phosphates such as triphenyl phosphate, tricresyl phosphate and diphenyl phosphate; phthalates such as diethyl phthalate and dimethoxyethyl phthalate; glycolates such as ethylphthalyl ethyl glycolate and butylphthalyl butyl glycolate; polymeric plastizers, e.g. and polyesters of polyethylene glycols with aliphatic dicarboxylic acids such as polyester of triethylene glycol with adipic acid and polyester of diethylene glycol with succinic acid.

After the formation of the fluorescent layer, a protective layer is generally provided on top of the fluorescent layer. In a preferred embodiment the protective coating has a layer thickness d comprised between 1 and 50 $\mu$m and an embossed surface roughness is applied for high ease of manipulation, thereby avoiding sticking, friction and electrostatic attraction with maintenance of an excellent image resolution. The embossed protective layer can be provided on the phosphor layer in order to protect it against mechanical and chemical damage by the steps of (1) coating onto said phosphor containing layer a liquid radiation-curable composition having at the coating temperature a viscosity of at least 380 mPa.s, measured with a Hoeppler viscometer,that does not penetrate for a substantial degree into the phosphor containing layer, (2) providing an embossed structure to the coating, and (3) curing said coating by radiation.

More details concerning preferred protective coatings with embossed surface can be found in EP-A's 0 510 753 and 0 510 754.

Assemblies providing means for reducing cross-over to less than 10% for radiation longer than 300 nm in wavelength have been described e.g. in U.S. Pat. No. 5,259,016.

According to the present invention a method of image formation is obtained by consecutively performing the steps of exposing to X-rays the radiographic screen/film combination or system described hereinbefore; followed by processing the film according to the present invention by the steps of developing, fixing, rinsing and drying.

The said processing is preferably performed in an automatic processing machine. More in detail for processing the film material of the present invention, preferably an automatically operating apparatus is used provided with a system for automatic replenishment of the processing solutions. The processing dry-to-dry within a short processing time of from 30 to 90 seconds and more preferably from 30 seconds to less than 60 seconds of materials coated from low amounts of silver is made possible by the steps of developing said material in a developer (preferably) without hardening agent;

fixing said material in a fixer, optionally without hardening agent;

rinsing and drying said material.

A normally used configuration in the processing apparatus shows the following consecutive tank units corresponding with, as consecutive solutions, developer, fixer and rinse water.

Recent developments however have shown, that from the viewpoint of ecology and especially with respect to reduction of replenishing amounts, as consecutive solutions the sequence developer-fixer-fixer-rinse water-rinse water is preferred. One washing step between developing and fixation and one at the end before drying may also be present.

As ecology and low replenishing amounts are main topics with respect to the present invention use is made of concentrated hardener free processing solutions in one single package. Examples thereof have been disclosed e.g. in U.S. Pat. Nos. 5,187,050 and 5,296,342.

Especially preferred developers comprising ecologically acceptable developing agents such as ascorbic acid and derivatives thereof have been described in EP-A 0 732 619 and in U.S. Pat. Nos. 5,593,817 and 5,604,082. Instead of or partially substituting (e.g. in a ratio by weight of from 1:1 up to 9:1) the ecologically questionable "hydroquinone" (iso) ascorbic acid, 1-ascorbic acid and tetramethyl reductic acid are preferred as main developing agent in the developer. Said developing agents have further been described in EP-A's 0 461 783, 0 498 968, 0 690 343, 0 696 759, 0 704 756, 0 732 619, 0 731 381 and 0 731 382; in U.S. Pat. Nos. 5,474,879 and 5,498,511 and in Research Disclosure No 371052, published Mar. 1, 1995, wherein a more general formula covering the formula of said developing agents has been represented.

In order to reduce "sludge formation" which is favored by solubilizing agents like sulphites, present in the developer as preservatives, a particularly suitable developer solution is the one comprising a reduced amount of sulphite and ascorbic acid which acts as a main developer and antioxidant as well and which is called "low-sludge" developer.

In favour of ecological fixation the presence of aluminum ions should be reduced, and more preferably, no aluminum ions should be present. This is moreover in favour of the absence of "sludge" formation, a phenomenon which leads to pi-line defects when high amounts of silver are coated in the light-sensitive layers. Measures in order to reduce "sludge-formation" have further been described in U.S. Pat. Nos. 5,447,817; 5,462,831 and 5,518,868. A particularly suitable fixer solution comprises an amount of less than 25 g of potassium sulphite per liter without the presence of acetic acid wherein said fixer has a pH value of at least 4.5, in order to make the fixer solution quasi odorless.

If however aluminum ions are present in the fixer composition for whatever a reason, the presence of $\alpha$-ketocarboxylic acid compounds is recommended as has been described in EP-A's 0 620 483 and 0 726 491 as well as in RD 16768, published March 1978.

It is possible to use sodium thiosulphate as a fixing agent, thus avoiding the ecologically undesirable ammonium ions normally used. For low coating amounts of emulsion crystals rich in chloride a fixation time which is reduced to about 2 to 10 seconds can be attained. Moreover regeneration is kept to a minimum, especially in the processing of materials coated from very low amounts of emulsion crystals rich in silver chloride. Preferred minimum regeneration or replenishment amounts are from 20 to 200 ml/m$^2$, more preferred from 20 to 100 ml/m$^2$, and still more preferred from 20 to 50 ml/m$^2$ of developed material. Materials coated from higher amounts of silver will require the higher amounts of replenisher but in most practical cases replenishment amounts of less than 200 ml/m$^2$ are attainable.

Replenishment of a developer comprising ascorbic acid or derivatives thereof and a 3-pyrazolidone derivative has been described in EP-A 0 573 700, wherein a method is disclosed for processing with constant activity image-wise exposed silver halide photographic material comprising the steps of developing photographic material in a continuous automatic way by means of a developing solution containing an ascorbic acid analogue or derivative and a 3-pyrazolidone derivative as developing agents and replenishing said developing solution by means of at least one replenishing solution having a higher pH than the developing solution. In an alternative method the replenisher is added as a powder. Other references related therewith are EP-A 0 552 511; U.S. Pat. No. 5,503,965 and further in EP-A 0 660 175, wherein a method of replenishment control is described. For the fixer preferred minimum regeneration or replenishment amounts are also from about 20 to 200 ml/m$^2$, more preferred from 20 to 100 ml/m$^2$ and still more preferred from 20 to 50 ml/m$^2$ of developed material. When aluminum ions are present in the fixer solution in order to effect hardening, it is necessary to adjust the pH of the fixer in the range from 4.2 to 4.6 in order to get the highest hardening reactivity and to suppress swelling with washing water in the washing or rinsing step. For hardened materials having a swelling degree of the hydrophilic layers of less than 250% and more preferably of less than 200% it is not required for the fixer pH to held constant in the pH range from 4.2 to 4.6 as mentioned hereinbefore: in order to reduce irritating smell from sulphite ions in aqueous acidic medium which lead to sulphur dioxide vapour it is recommended to enhance pH to a value of 4.65 up to 5.00. A process whereby the quality of the fixer remains at an optimum level has been described in EP-A 0872 764.

Although it is possible to use whatever a processing unit adapted to the requirements described hereinbefore to reach the objectives concerning a perfect link between rapid processing and ecology, the objects of this invention concerning processing have e.g. been realized in the processing unit CURIX HT 530, trade name product marketed by Agfa-Gevaert.

New developments however become available with respect to processing apparatus. In a conventional processing apparatus the sheet material is transported along a generally horizontal feed path, the sheet material passing from one vessel to another usually via a circuitous feed path passing under the surface of each treatment liquid and over dividing walls between the vessels. However, processing machines having a substantially vertical orientation have also been proposed, in which a plurality of vessels are mounted one above the other, each vessel having an opening at the top acting as a sheet material inlet and an opening at the bottom acting as a sheet material outlet or vice versa. In the present context, the term "substantially vertical" is intended to mean that the sheet material moves along a path from the inlet to the outlet which is either exactly vertical, or which has a vertical component greater than any horizontal component. The use of a vertical orientation for the apparatus leads to a number of advantages. In particular the apparatus occupies only a fraction of the floor space which is occupied by a conventional horizontal arrangement. Furthermore, the sheet transport path in a vertically oriented apparatus may be substantially straight, in contrast to the circuitous feed path which is usual in a horizontally oriented apparatus.

It is clear that within the scope of the present invention any screen/film combination may be used, wherein said screen comprises at least luminescent phosphors as e.g. gadolinium oxysulfide phosphors emitting green light in the wavelength range from 540 to 555 nm, and wherein said film comprises {111} tabular silver halide crystals rich in silver bromide spectrally sensitized with at least one or more other cyanine dyes (like monomethine or azacyanine dyes) in combination with a processing unit, provided that with minimum amounts of silver coated (total amount, expressed as an equivalent amount of silver nitrate of less than 6.0 g /m$^2$, particularly for double-side coated materials) sufficient covering power is attained in the film in rapid ecological processing (with e.g. ascorbic acid and/or derivatives thereof as developing agent(s) in a hardener-free developer and an odor-free fixer, optionally free from aluminum ions, thereby reducing sludge; and replenishing amounts for developer and fixer as low as possible, i.e. from about 20 ml/m$^2$ up to at most 200 ml/m$^2$) and provided that an optimal relationship is attained between sensitometry and image quality, especially sharpness, thanks to low cross-over exposure, without residual color, thus providing a good image tone, and wherein moreover said image tone and sensitometry is influenced to a lesser extent by changes of photographic properties on development processing conditions, more particularly with respect to processing in weak or exhausted developers.

The following examples illustrate the present invention without however limiting it thereto.

EXAMPLES

While the present invention will hereinafter be described in connection with preferred embodiments thereof, it will be understood that it is not intended to limit the invention to those embodiments.

1. Emulsion Preparation

To a solution of 7.5 g of oxidized gelatin, free from Ca-ions, in 3 l of demineralized water at 25° C., adjusted to a pH of 1.8 by adding $H_2SO_4$ and a pBr of 2.39 by adding a diluted solution of potassium bromide, stirred up to a rate of 700 r.p.m., were added by a double jet method aqueous solutions of 1.96 M $AgNO_3$ (hereinafter referred to as A1) and 1.96 M KBr (hereinafter referred to as B1): 4.2 ml of A1 and 4.2 ml of B1 were added in a time interval of 30 seconds. After a physical ripening time of 90 seconds the temperature was increased up to 45° C. over a period of 30 minutes, followed by another 10 minutes during which the temperature was held at 45° C. and after which a solution of 50 g of gelatin (oxidized gelatin, free from Ca-ions) in 500 ml of demineralized water of 45° C. was added. 2 minutes later pH was adjusted to a value of 5.0.

7 minutes later B1 was added at a rate of 7.5 ml/min. during 436 seconds, followed by a neutralization step, adding therefor A1 at a rate of 5.5 ml/min., while adding B1 at a rate in order to get a UAg of −20 mV at a temperature of 45° C., corresponding with a pBr value of 1.47 (pAg= 9.94).

In a double jet addition A1 and B1 were added during a growth step taking 7248 seconds at a linearly increasing rate going from 5.5 up to 19.2 ml/min., while adding B1 in order to maintain a constant UAg potential of −20 mV in the reaction vessel, corresponding with a pAg of 9.94. 3 minutes after ending that double-jet addition period, an amount of an emulsion having ultrafine (ca. 0.040 $\mu$m) 100 t AgI Crystals, was added to the reaction vessel in a time of 2 minutes in order to get a total AgI content at the end of precipitation of 0.1 mole % vs. silver precipitated (and 99.9 mole % of AgBr).

The average grain sizes of the silver bromoiodide tabular {111} emulsion grains thus prepared, have been calculated as follows:

* as average equivalent volume diameter—measured by Möller counting apparatus, expressing volume of each separate grain after electrochemical reduction—a value of 0.56 μm was obtained; and a

* as average equivalent surface area—measured from electron microscopic photographs—a value of 1.16 μm was obtained; with a variation thereupon of 0.45;

* as average thickness, measured from shadowed replicas obtained by electron microscopy, a value of 0.060 μm was obtained.

After addition of polystyrene sulphonic acid, followed by decrease of pH in order to flocculate the emulsion, a washing procedure followed by decanting supernatant liquid, and peptization after addition of gelatin, was leading to an emulsion having a gesi of 0.5 and silver, expressed as an equivalent amount if silver nitrate in an amount of 230 g/kg.

2. Chemical Sensitization

As spectral sensitizers following compounds 1 and 2 for the inventive material coatings (amounts indicated in the Table 1 hereinafter) were added (compound 1 and 3 for the comparative coating):

(I.1)

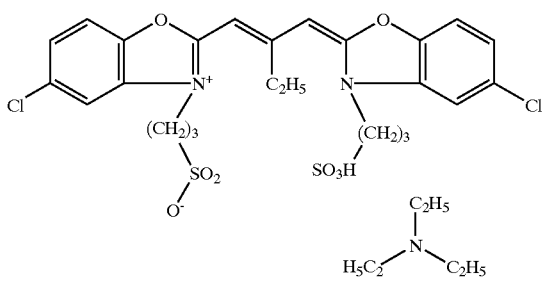

Compound 1 (as a main spectral sensitizer added in a solution, having a concentration of 2.783 μmole per ml). Amounts of this main spectral sensitizer were the same for all coating materials.

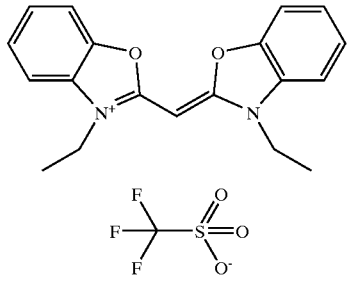

Compound 2 (as additional spectral sensitizer added in a solution, having a concentration of 8.763 μmole per ml) added in an amount indicated as "z" in Table 1 hereinafter.

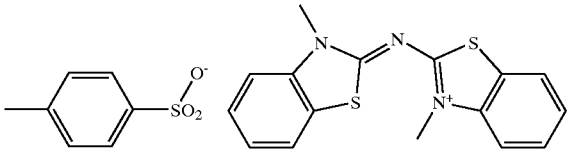

Compound 3 (as comparative additional spectral sensitizer added in a solution, having a concentration of 20.68 μmole per ml)

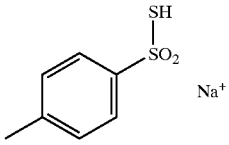

Compound 4 (as stabilizing agent added in a solution having a concentration of 4.76 μmole/ml) was always added in an amount of 0.2 ml per 500 g of $AgNO_3$.

As chemical sensitizers 6 ml of a sodium thiosulphate solution (0.1% solution of the pentahydrate product),×ml of ammonium gold thiocyanate (solution having a concentration of 1.456 μmole/ml), y ml of compound 5, present as sodium salt (solution having a concentration of 37.57) mμole/ml) and 7 ml of compound 6 (solution having a concentration of 3.494 μmole/ml)

Compound 5

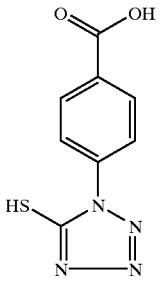

Compound 6

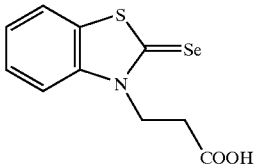

Coating of the Materials

Preparation of the Film Material

As stabilizers in the emulsion layer coatings 0.1 mmole of 1-(m-carboxymethylthioacetamido)-phenyl-5-mercaptotetrazole and 0.6 mmole of 5-methyl-1,2,4-triazolo-(1,5-A)-pyrimidine-7-ol were added per mole of silver. Resorcinol was added as hardener accelerator in an amount of 2.8 g per mole of Ag. Consecutively 0.5 g of polyglycol (MW=6000) was added as a development accelerator; 20 ml of polyoxyethylene surfactant H17C8-Phenyl-(O—CH2—CH2)8—O—CH2—COOH and in an amount of 140 mg (per mole of Ag) fluoroglucinol was added as a hardener stabilizer together with polymethyl acrylate latex (in an amount of 140% by weight, based on the amount of gelatin binder) which was used as a plasticizer. The thus prepared emulsion coating solutions were coated on a blue colored polyethylene terephthalate support (density of the support measured to be 0.200) in such an amount in order to give a coating weight of 2.00 g/m2 per side in terms of AgNO3 and 1.29 g of gelatin per m2 per side.

The following protective layer was coated thereupon (pH value: 6.25) at both sides:

| Composition of the protective antistress layer | |
|---|---|
| Gelatin | 1.11 g/m$^2$ |
| Graft copolymer (7) | 14 mg/m$^2$ |
| Chromium acetic acid | 7.3 mg/m$^2$ |
| Compound (8) | 16 mg/m$^2$ |
| Compound (9) | 6.7 mg/m$^2$ |
| Mobilcer Q (MMM trademarked product) | 9 ml/m$^2$ |
| Compound (10) | 15 mg/m$^2$ |
| Compound (11) | 40 mg/m$^2$ |

Compound (7)

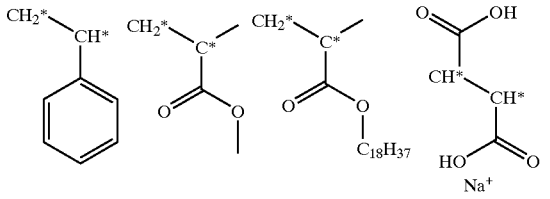

Compound (8)

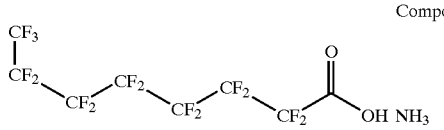

Compound (9)

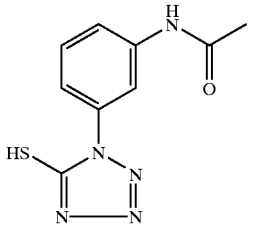

Compound (10)

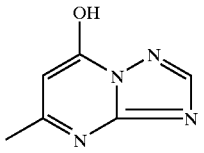

Compound (11)

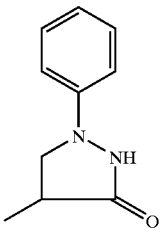

Film materials were called F2–F5 for those coated with the inventive emulsions and F1 for the one coated with the comparative emulsion in the light-sensitive emulsion layer of the respective film materials.

Samples of these coatings were exposed with green light of 540 nm during 0.1 seconds using a continuous wedge and were processed.

The processing was run in the developer G138i, trademarked product from Agfa-Gevaert N. V., Mortsel, Belgium, followed by fixing in fixer G334i, trademarked product from Agfa-Gevaert N. V., Mortsel, Belgium,and rinsing at the indicated temperature of 33° C. for a total processing time of 90 seconds.

In order to make a comparison between differing processing cycles besides a processing in G138i (trademarked product form Agfa-Gevaert), another cycle was run in the weak hydroquinone developer I347, pH set at 10.0, the composition of which is given in the Table 1 hereinafter (fixer being the same as hereinbefore, namely G334).

For total processing times of 90 s (35° C.) data in for differing developer temperatures have been given for Speed in the Table 1 and differences in speed were calculated.

TABLE 1

| Composition of weak hydroquinone developer | |
|---|---|
| Developer H2Q | |
| Hydroquinone | 13.3 g/l |
| Phenidone | 0.8 g/l |
| Sodium EDTA | 1.33 g/l |
| Potassium hydroxide | 27.9 g/l |
| Sodium tetraborate.10 aq | 8.8 g/l |
| Acetic acid | 5.2 g/l |
| 5-methyl benzotriazole | 0.04 g/l |
| 5-nitrobenzimidazole | 0.05 g/l |
| glutardialdehyde | 3.0 g/l |
| diethylene glycol | 12.8 g/l |

Sensitometric and other useful parameters given in Table 2 are

Fog "F", given as an integer after having multiplied the real fog density as measured with a factor of 1000;

Speed "S", given as an integer after having multiplied the sensitivity measured at a density of 1.00 above minimum density as measured with a factor of 100;— an decrease of speed with a figure of 30 corresponding with a doubling in speed—;

Covering power "CP", given as density of the "DLS" as measured after subtraction of the density of the suppport, multiplied with a factor of 100, further divided by the coating amount of silver per sq.m., said silver amount expressed as silver nitrate equivalent;

"DLS": Density (of the) last (measurable) step (density in the shoulder part of the sensitometric curve (before reaching maximum density Dmax)

Image tone "IT", evaluated from figures corresponding with Dr, wherefore data are summarized with respect to the density Dr measured through a red filter at a blue density Db=2: the higher this value (figure multiplied by a factor of 100), the better (more desired blue-black instead of undesired red-brown) is the color of the developed silver.

TABLE 2

| Material No. | | | | | | | | |
|---|---|---|---|---|---|---|---|---|
| Spectral Sensitizer | x/y/z | F | S | DLS | CP | IT: G138 | IT: I347 | ΔIT |
| 1 (Comp. 3) | 12/10/146 | 195 | 176 | 341 | 97 | 183 | 175 | −8 |
| 2 (Comp. 2) | 12/10/125 | 227 | 180 | 338 | 93 | 181 | 179 | −2 |
| 3 (Comp. 2) | 14/10/125 | 202 | 183 | 334 | 94 | 182 | 179 | −3 |
| 4 (Comp. 2) | 12/10/75 | 232 | 190 | 317 | 89 | 184 | 181 | −3 |
| 5 (Comp. 2*) | 14/10/125 | 219 | 177 | 316 | 88 | 187 | 185 | −2 |

*Chemical sensitization at 70° C. instead of 56° C.; amount of compound 6: 5.8 ml instead of 7 ml; 5 ml sodium thiosulphate instead of 6 ml.

As becomes clear from the data in Table 2 differences in image tone remain almost the same when a combination of spectral sensitizers according to the present invention is applied to the thin tabular crystals, which was reflected in the small negligible differences for the "IT" results, reflecting "image tone" values, in both developers (strong and weak respectively)—see more particular the Materials Nos. 4–5. For about the same covering power, a comparable speed and density is maintained. Moreover a shift of maximum absorption wavelength of less than 10 nm (3 and 4 nm respectively) was measured for the dye mixtures set forth in the Table versus in the absence of any other dye (thus with the main J-aggregating green-sensitizing oxacarbocyanine dye). Said shift was determined in a SHIMADZU UV-2101 PC UV-VIS spectrophotometer.

Having described in detail preferred embodiments of the current invention, it will now be apparent to those skilled in the art that numerous modifications can be made therein without departing from the scope of the invention as defined in the appending claims.

What is claimed is:

1. Film material having at least one emulsion comprising {111} tabular silver halide grains rich in silver bromide, spectrally sensitive to irradiation in the wavelength range between 540 and 555 nm by the presence of a combination of at least one J-aggregating spectrally sensitizing cyanine dye according to the formula (I)

(I)

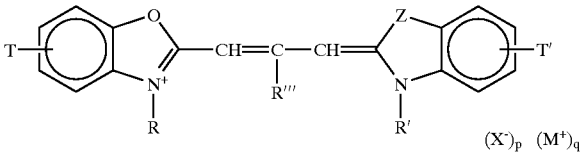

wherein

Z represents a nitrogen or an oxygen atom and is substituted with R" if Z is a nitrogen atom, R, R' and R" each independently represent substituted or unsubstituted alkyl, R''' represents hydrogen, substituted or unsubstituted alkyl or substituted or unsubstituted aryl, T and T' each independently represent the usual substituents known in the art, $(X^-)_p$ represents an negatively charged atom or group of atoms to compensate for the positive charge(s) present on the dye, and $(M^+)_q$ represents a positively charged atom or group of atoms to compensate for the negative charge(s) present on the dye, wherein p and q each represent an integer in order to get an electronically neutral compound;

and of at least one additional cyanine dye, characterized in that said additional cyanine dye or dyes provide(s) a shift of maximum absorption wavelength of said combination being less than 10 nm versus in the absence thereof, wherein said additional dye or dyes is at least one monomethine cyanine dye, and wherein said monomethine cyanine dye corresponds to the formula (II)

(II)

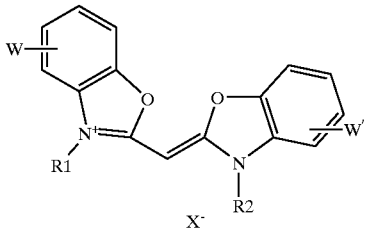

wherein each of $R^1$ and $R^2$ independently represents a substituted or unsubstituted $C_1$–$C_5$ alkyl chain, or a substituted or unsubstituted (five- or six-membered) aromatic ring, provided that at least one of $R^1$ and $R^2$ has a solubilizing group or a latent solubilizing group;

wherein W and W' each independently represents a substituted or unsubstituted alkyl, a substituted or unsubstituted aryl or a substituted or unsubstituted heterocyclic group and wherein X is an anion, providing electrical neutrality, and said material moreover comprises at least one azacyanine dye.

2. Film material according to claim 1, wherein said {111} tabular silver halide grains rich in silver bromide have a silver iodide content of less than 3 mole %, based on silver, and have an average aspect ratio of 5 or more, an average grain thickness of at most 0.25 $\mu$m, and account for at least 50% of the total projective area of all grains.

3. Film material according to claim 1, wherein said {111} tabular silver halide grains rich in silver bromide have an average aspect ratio of from 5 up to 20, an average grain thickness of less than 0.1 $\mu$m, and account for at least 70% of the total projective area of all grains.

4. Film material according to claim 1, wherein said {111} tabular silver halide grains rich in silver bromide are chemically sensitized with compounds providing sulphur, selenium and gold.

5. Radiographic screen/film combination comprising a duplitized film material sandwiched between a pair of supported or self-supporting X-ray intensifying screens, characterized in that i) said pair of supported or self-supporting X-ray intensifying screens essentially consists of luminescent phosphor particles emitting at least 50% of their emitted radiation in the wavelength range between 540 and 555 nm, ii) said film material is a material according to claim 1, wherein said emulsion is present in at least one light-sensitive emulsion layer at both sides of a film support.

6. Radiographic screen/film combination according to claim 5, wherein said luminescent phosphor particles are $Gd_2O_2S$:Tb phosphor particles.

7. Radiographic screen/film combination according to claim 6, wherein a total amount of coated silver halide in said film, expressed as an equivalent amount of silver nitrate, is less than 6.0 g/m$^2$.

8. Radiographic screen/film combination comprising a duplitized film material sandwiched between a pair of supported or self-supporting X-ray intensifying screens, characterized in that i) said pair of supported or self-supporting X-ray intensifying screens essentially consists of luminescent phosphor particles emitting at least 80% of their emitted radiation in the wavelength range between 540 and 555 nm, ii) said film material is a material according to claim 1, wherein said emulsion is present in at least one light-sensitive emulsion layer at both sides of a film support.

9. Radiographic screen/film combination according to claim 8, wherein said luminescent phosphor particles are $Gd_2O_2S$:Tb phosphor particles.

10. Radiographic screen/film combination according to claim 9, wherein a total amount of coated silver halide in said film, expressed as an equivalent amount of silver nitrate, is less than 6.0 g/m$^2$.

11. Film material having at least one emulsion comprising {111} tabular silver halide grains rich in silver bromide, spectrally sensitive to irradiation in the wavelength range between 540 and 555 nm by the presence of a combination of at least one J-aggregating spectrally sensitizing cyanine dye according to the formula (I)

(I)

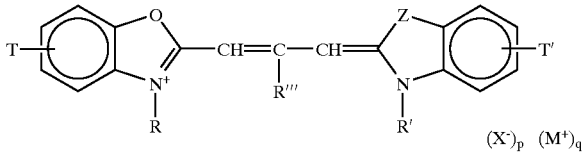

wherein

Z represents a nitrogen or an oxygen atom and is substituted with R" if Z is a nitrogen atom, R, R' and R" each independently represent substituted or unsubstituted alkyl, R'" represents hydrogen, substituted or unsubstituted alkyl or substituted or unsubstituted aryl, T and T' each independently represent the usual substituents known in the art, $(X^-)_p$ represents an negatively charged atom or group of atoms to compensate for the positive charge(s) present on the dye, and $(M^+)_q$ represents a positively charged atom or group of atoms to compensate for the negative charge(s) present on the dye, wherein p and q each represent an integer in order to get an electronically neutral compound;

and of at least one additional cyanine dye, characterized in that said additional cyanine dye or dyes provide(s) a shift of maximum absorption wavelength of said combination being less than 10 nm versus in the absence thereof, wherein said additional dye or dyes is at least one monomethine cyanine dye, and wherein said monomethine cyanine dye corresponds to one of the formulae (II.1)–(II.3)

(II.1)

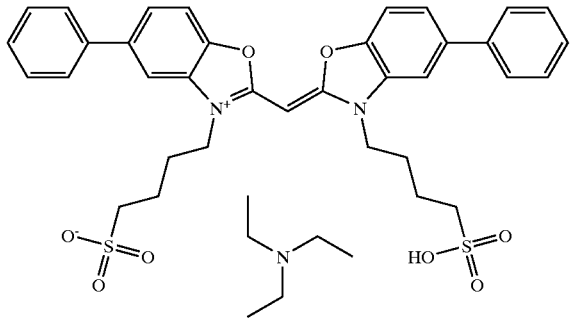

(II.2)

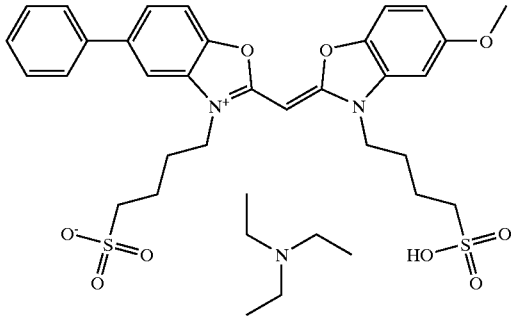

(II.3)

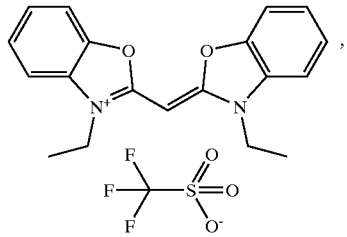

and said material moreover comprises at least one azacyanine dye.

12. Film material according to claim 11, wherein said {111} tabular silver halide grains rich in silver bromide have a silver iodide content of less than 3 mole %, based on silver, and have an average aspect ratio of 5 or more, an average grain thickness of at most 0.25 $\mu$m, and account for at least 50% of the total projective area of all grains.

13. Film material according to claim 11, wherein said {111} tabular silver halide grains rich in silver bromide have an average aspect ratio of from 5 up to 20, an average grain thickness of less than 0.1 $\mu$m, and account for at least 70% of the total projective area of all grains.

14. Film material according to claim 11, wherein said {111} tabular silver halide grains rich in silver bromide are chemically sensitized with compounds providing sulphur, selenium and gold.

15. Radiographic screen/film combination comprising a duplitized film material sandwiched between a pair of supported or self-supporting X-ray intensifying screens, characterized in that i) said pair of supported or self-supporting X-ray intensifying screens essentially consists of luminescent phosphor particles emitting at least 50% of their emitted radiation in the wavelength range between 540 and 555 nm, ii) said film material is a material according to claim 11, wherein said emulsion is present in at least one light-sensitive emulsion layer at both sides of a film support.

16. Radiographic screen/film combination according to claim 15, wherein said luminescent phosphor particles are $Gd_2O_2S$:Tb phosphor particles.

17. Radiographic screen/film combination according to claim 16, wherein a total amount of coated silver halide in said film, expressed as an equivalent amount of silver nitrate, is less than 6.0 g/$m^2$.

18. Radiographic screen/film combination comprising a duplitized film material sandwiched between a pair of supported or self-supporting X-ray intensifying screens, characterized in that i) said pair of supported or self-supporting X-ray intensifying screens essentially consists of luminescent phosphor particles emitting at least 80% of their emitted radiation in the wavelength range between 540 and 555 nm, ii) said film material is a material according to claim 11, wherein said emulsion is present in at least one light-sensitive emulsion layer at both sides of a film support.

19. Radiographic screen/film combination according to claim 18, wherein said luminescent phosphor particles are $Gd_2O_2S$:Tb phosphor particles.

20. Radiographic screen/film combination according to claim 19, wherein a total amount of coated silver halide in said film, expressed as an equivalent amount of silver nitrate, is less than 6.0 g/$m^2$.

* * * * *